US009052640B2

(12) United States Patent
Kashiide et al.

(10) Patent No.: US 9,052,640 B2
(45) Date of Patent: Jun. 9, 2015

(54) DEVELOPER ACCOMMODATING UNIT, DEVELOPING DEVICE, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Yosuke Kashiide, Tokyo (JP); Noritomo Yamaguchi, Kawasaki (JP); Yuichi Fukui, Yokosuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 4 days.

(21) Appl. No.: 13/894,828

(22) Filed: May 15, 2013

(65) Prior Publication Data

US 2013/0308971 A1 Nov. 21, 2013

(30) Foreign Application Priority Data

May 17, 2012 (JP) ..... 2012-113246
May 7, 2013 (JP) ..... 2013-097299

(51) Int. Cl.
*G03G 15/08* (2006.01)
*G03G 21/16* (2006.01)

(52) U.S. Cl.
CPC ..... *G03G 15/0898* (2013.01); *G03G 15/0874* (2013.01); *G03G 21/1676* (2013.01); *G03G 15/0841* (2013.01); *G03G 15/0882* (2013.01)

(58) Field of Classification Search
CPC ..... G03G 15/0841; G03G 15/0874; G03G 21/1676; G03G 2215/0682; G03G 2215/0687; G03G 2215/0875; G03G 15/0882; G03G 15/0898
USPC ..... 399/103, 106, 119, 120, 258
See application file for complete search history.

(56) References Cited

U.S. PATENT DOCUMENTS 5,030,998 A * 7/1991 Shibata et al. ..... 399/106
5,264,901 A * 11/1993 Rossiter ..... 399/106
7,890,019 B2 2/2011 Tateishi et al.

(Continued)

FOREIGN PATENT DOCUMENTS

JP 03221981 A * 9/1991
JP 04-066980 3/1992
JP H09-288425 A 11/1997

OTHER PUBLICATIONS

Office Action in Taiwanese Patent Application No. 102117212, dated Jan. 16, 2015 (with English translation).

*Primary Examiner* — Ryan Walsh
(74) *Attorney, Agent, or Firm* — Fitzpatrick, Cella, Harper & Scinto

(57) ABSTRACT

A developer accommodating unit includes: a developer accommodating member, provided with an opening for permitting discharge of a developer, for accommodating the developer; a sealing member including a connecting portion for being connected to the developer accommodating member so as to seal the opening; and an unsealing member for exposing the opening by moving the sealing member to peel the connecting portion from the developer accommodating member. The connecting portion includes a first connecting portion and a second connecting portion with respect to a longitudinal direction thereof. When the connecting portion is peeled from the developer accommodating member, the unsealing member is flexed so that the first connecting portion is peeled earlier than the second connecting portion.

40 Claims, 15 Drawing Sheets

(56) References Cited

U.S. PATENT DOCUMENTS

| | | | | |
|---|---|---|---|---|
| 8,059,989 | B2 | 11/2011 | Tateishi et al. | |
| 8,238,786 | B2 | 8/2012 | Yamaguchi et al. | |
| 2008/0240772 | A1 * | 10/2008 | Nishikawa | 399/106 |
| 2011/0200353 | A1 | 8/2011 | Kubo et al. | |
| 2011/0286768 | A1 | 11/2011 | Muto et al. | |
| 2013/0022368 | A1 | 1/2013 | Takarada et al. | |
| 2013/0114972 | A1 | 5/2013 | Takarada et al. | |
| 2013/0164029 | A1 | 6/2013 | Fukui et al. | |
| 2013/0177334 | A1 | 7/2013 | Nonaka et al. | |
| 2013/0209137 | A1 | 8/2013 | Hayashi et al. | |

* cited by examiner (a)

(b)

(a)

(b)

(a)

(b)

(c)

(d)

DEVELOPER ACCOMMODATING UNIT, DEVELOPING DEVICE, PROCESS CARTRIDGE AND ELECTROPHOTOGRAPHIC IMAGE FORMING APPARATUS

FIELD OF THE INVENTION AND RELATED ART

The present invention relates to a developer accommodating unit, and a developing device, a process cartridge and an image forming apparatus which use the developer accommodating unit.

The image forming apparatus forms an image on a recording material (medium) by using, e.g., an electrophotographic image forming process and may include, e.g., an electrophotographic copying machine, an electrophotographic printer (such as an LED printer or a laser beam printer), an electrophotographic facsimile machine and the like.

Further, the process cartridge is prepared by integrally assembling a photosensitive member as an image bearing member and process means, such as a developing means, acting on the photosensitive member into a cartridge, which is detachably mountable to a main assembly of the electrophotographic image forming apparatus.

In a conventional electrophotographic image forming apparatus using the electrophotographic image forming process, a cartridge type in which an electrophotographic photosensitive member and process means acting on the photosensitive member are integrally assembled into a cartridge and this cartridge is detachably mountable to a main assembly of the electrophotographic image forming apparatus is employed.

In such a cartridge, as shown in FIG. 14, an opening provided to a developer accommodating container 100 for accommodating a developer (toner, carrier, etc.) is sealed with a sealing member 101 constituted by a seal member or the like. A type in which a connecting portion 102 of the sealing member 101 is peeled off when used and thus the opening is unsealed (opened) to permit feeding of the developer has been widely used (Japanese Laid-Open Patent Application (JP-A) Hei 4-66980, U.S. Patent Application Publication No. US2011/0286768 A1).

Further, a cartridge in which the developer accommodating container 100 is made deformable in order to solve a problem that the developer is scattered in the cartridge in a developer filling step during manufacturing of the cartridge has been devised (JP-A Hei 4-66980).

However, when the toner seal was intended to be peeled off at one time, there was a possibility that a torque necessary for unsealing became large to exert a large load on a motor for a main assembly of the image forming apparatus. For that reason, when output specification of the motor of the main assembly of the image forming apparatus is increased, the motor is upsized or a high-output motor is needed, so that a cost is increased.

SUMMARY OF THE INVENTION

A principal object of the present invention is to provide a developer accommodating unit capable of reducing a load exerted on a motor when an opening of a developer accommodating member is unsealed.

According to an aspect of the present invention, there is provided a developer accommodating unit comprising: a developer accommodating member, provided with an opening for permitting discharge of a developer, for accommodating the developer; a sealing member including a connecting portion for being connected to the developer accommodating member so as to seal the opening; and an unsealing member for exposing the opening by moving the sealing member to peel the connecting portion from the developer accommodating member, wherein the connecting portion includes a first connecting portion and a second connecting portion with respect to a longitudinal direction thereof, and wherein when the connecting portion is peeled from the developer accommodating member, the unsealing member is flexed so that the first connecting portion is peeled earlier than the second connecting portion.

According to another aspect of the present invention, there is provided a developer accommodating unit for accommodating the developer; comprising: a developer accommodating member provided with an opening for permitting discharge of a developer; a sealing member including a connecting portion for being connected to the developer accommodating member so as to seal the opening; and an unsealing member for exposing the opening by moving the sealing member to peel the connecting portion from the developer accommodating member, wherein the unsealing member has an outer configuration different between at its longitudinal central portion and at its longitudinal end portion.

According to a further aspect of the present invention, there are provided a developing device, a process cartridge and an image forming apparatus which use the above-described developer accommodating units.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Parts (a), (b) and (c) of FIG. 1 are illustrations each showing an unsealing member and its peripheral portion in First Embodiment of the present invention.

Figure 7:
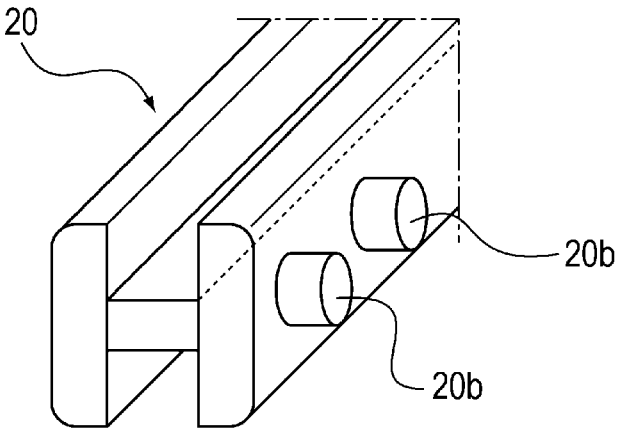
Figure 7:
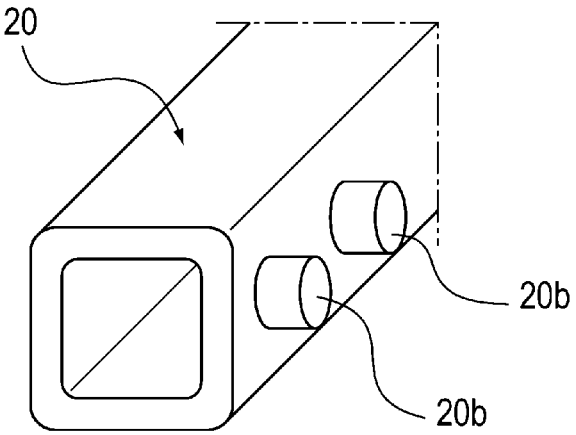

Parts (a) and (b) of FIG. 7 are perspective views each showing a shape of the unsealing member in First Embodiment of the present invention.

Figure 8:
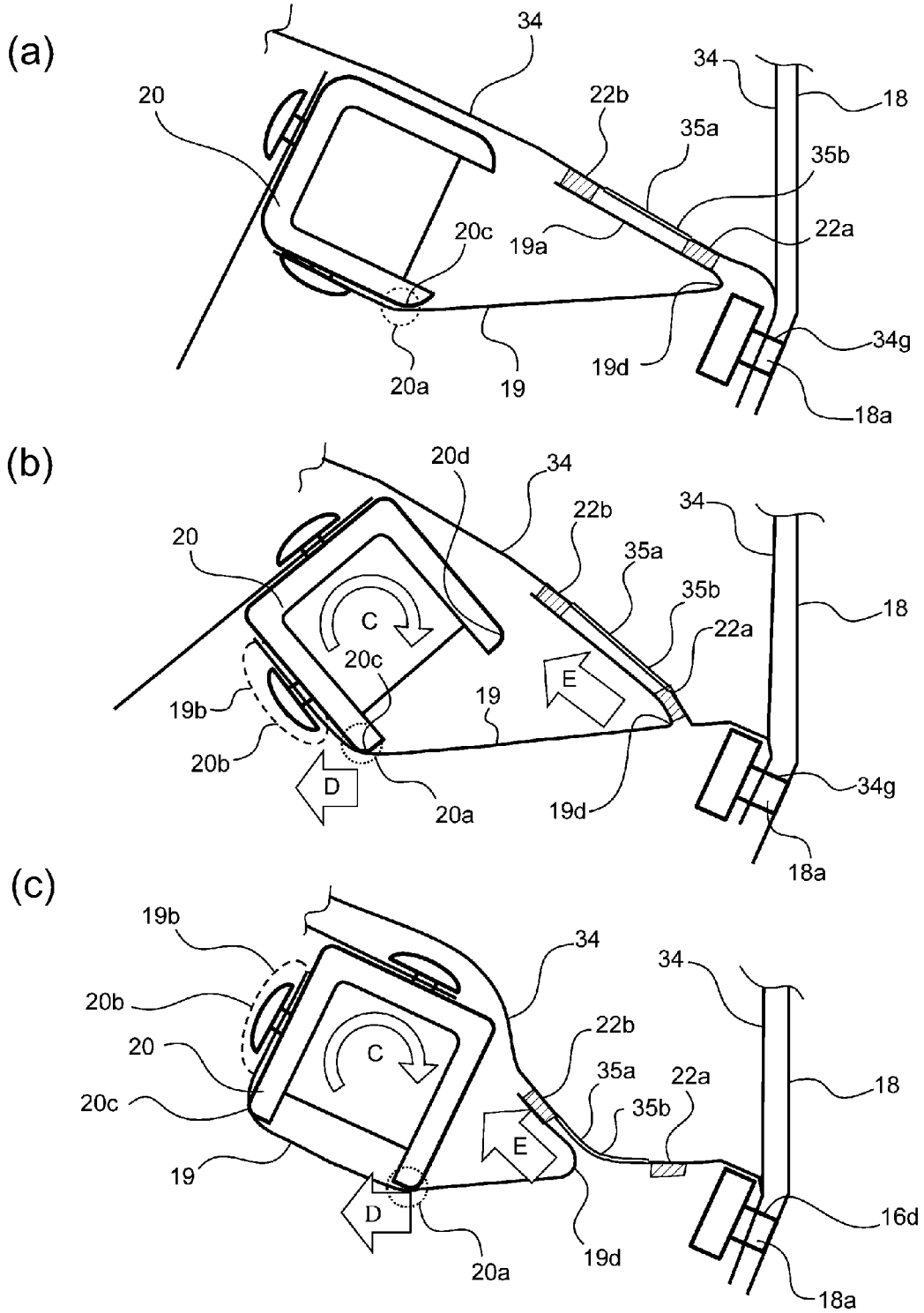

Parts (a), (b) and (c) of FIG. 8 are enlarged sectional views each showing the unsealing member and its peripheral portion in First Embodiment of the present invention.

Figure 9:
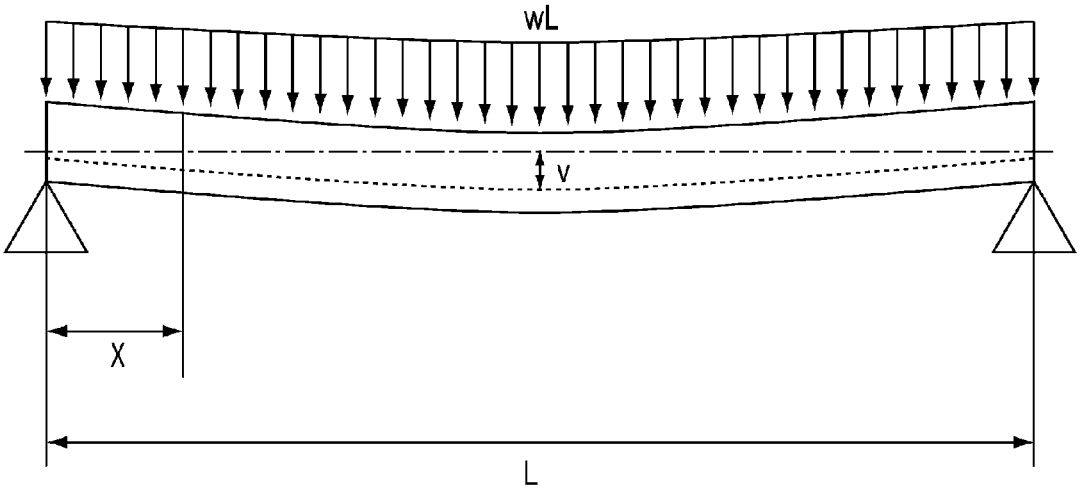

FIG. 9 is a schematic illustration of a flexure model of a simple beam on which a uniform load acts.

Figure 10:
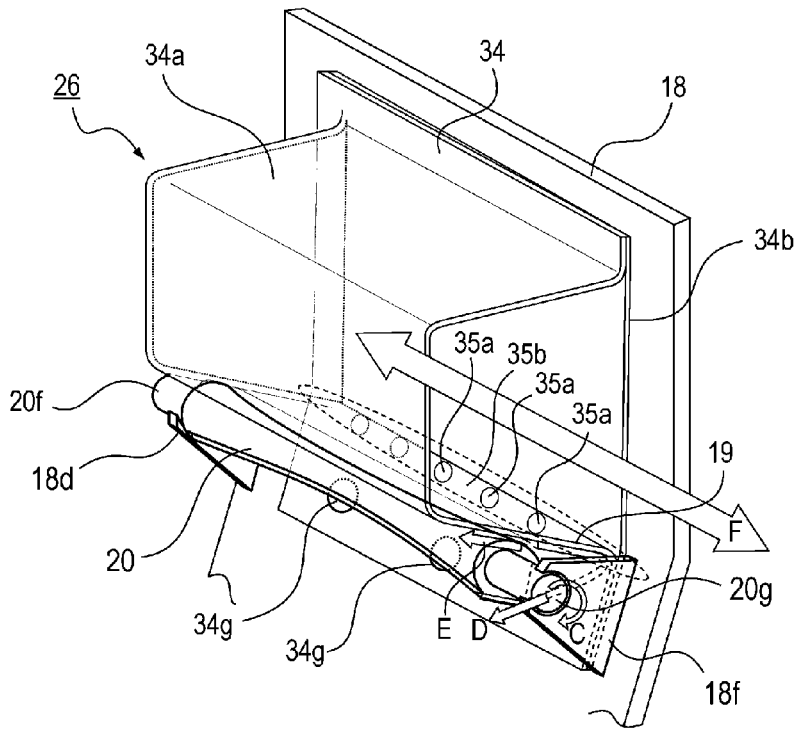
Figure 10:
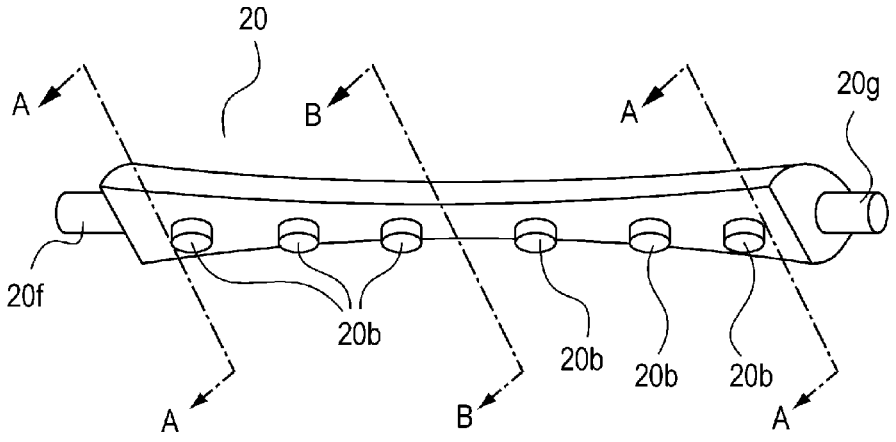

Parts (a) and (b) of FIG. 10 are illustrations each showing an unsealing member and its peripheral portion in Second Embodiment of the present invention.

Figure 11:
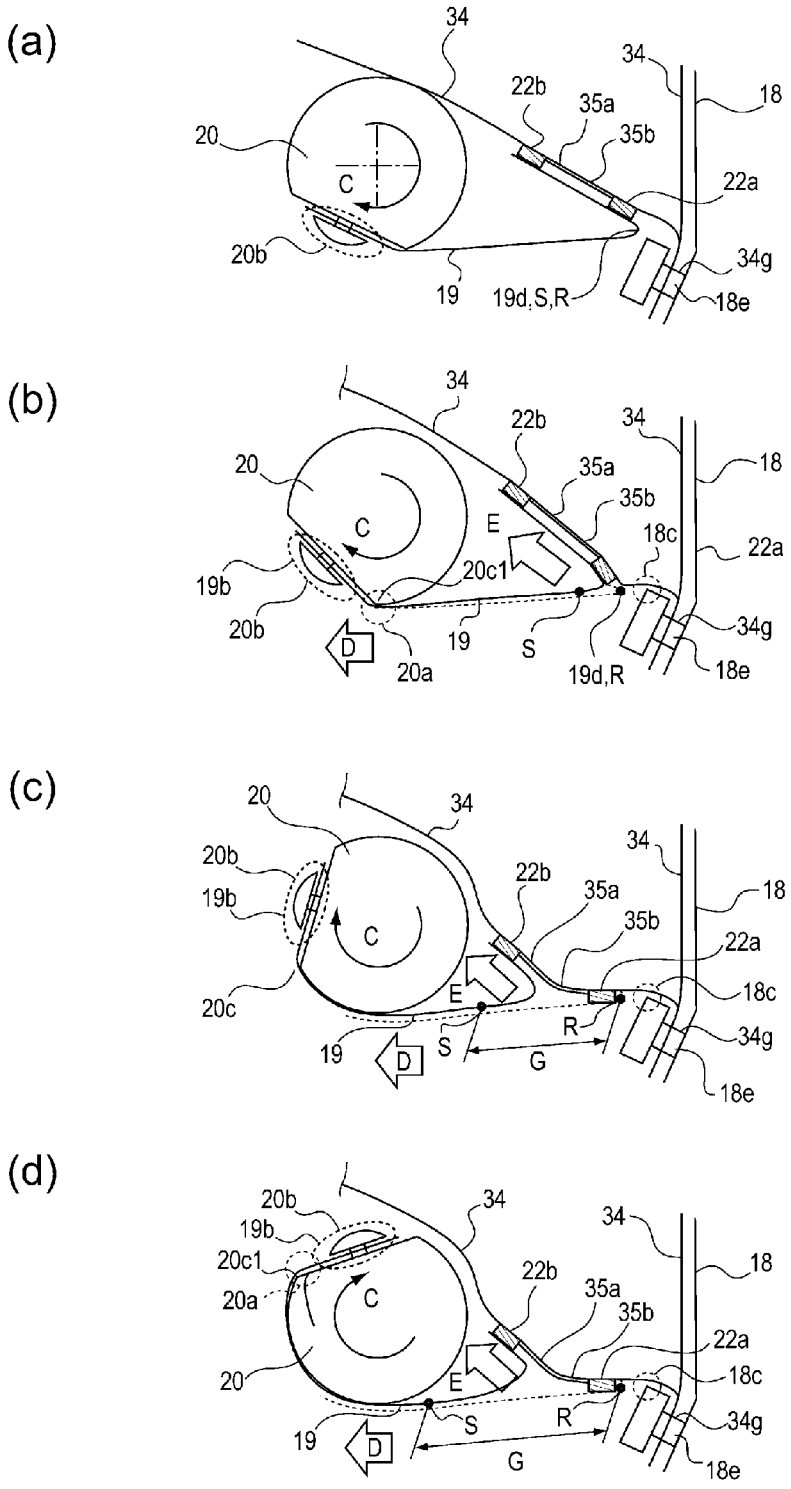

Parts (a) to (d) of FIG. 11 are enlarged sectional views each showing an unsealing member end portion in Second Embodiment of the present invention.

Figure 12:
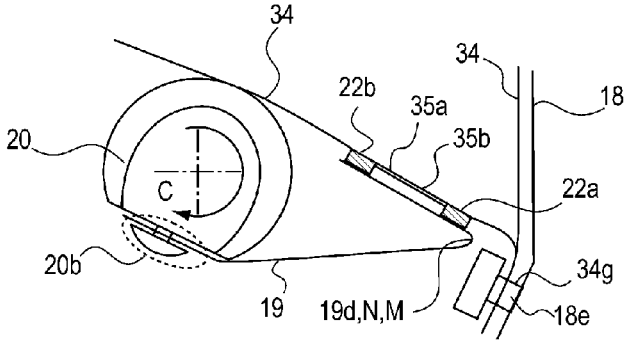
Figure 12:
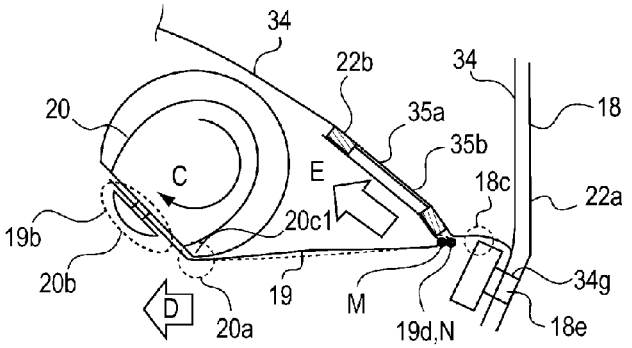
Figure 12:
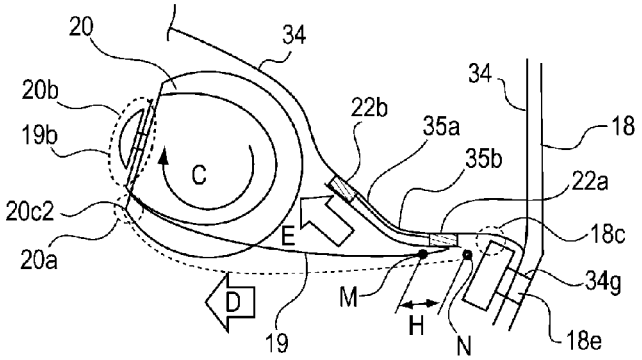
Figure 12:
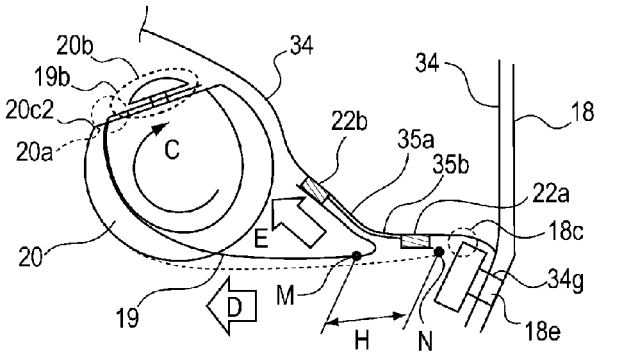

Parts (a) to (d) of FIG. 12 are enlarged sectional views each showing an unsealing member central portion in Second Embodiment of the present invention.

Figure 13:
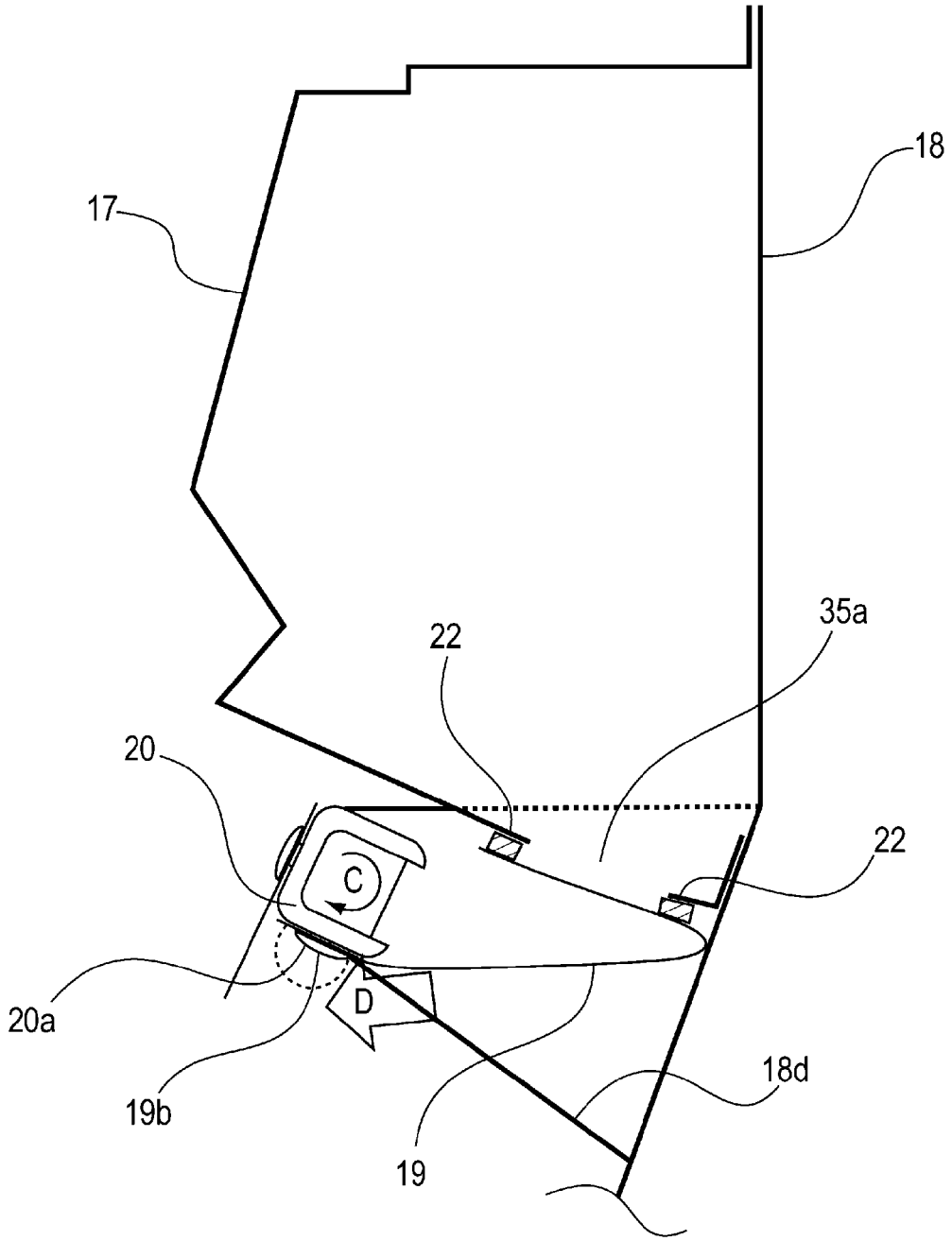

FIG. 13 is a sectional view of a structure of a developer accommodating unit in Third Embodiment of the present invention.

Figure 14:
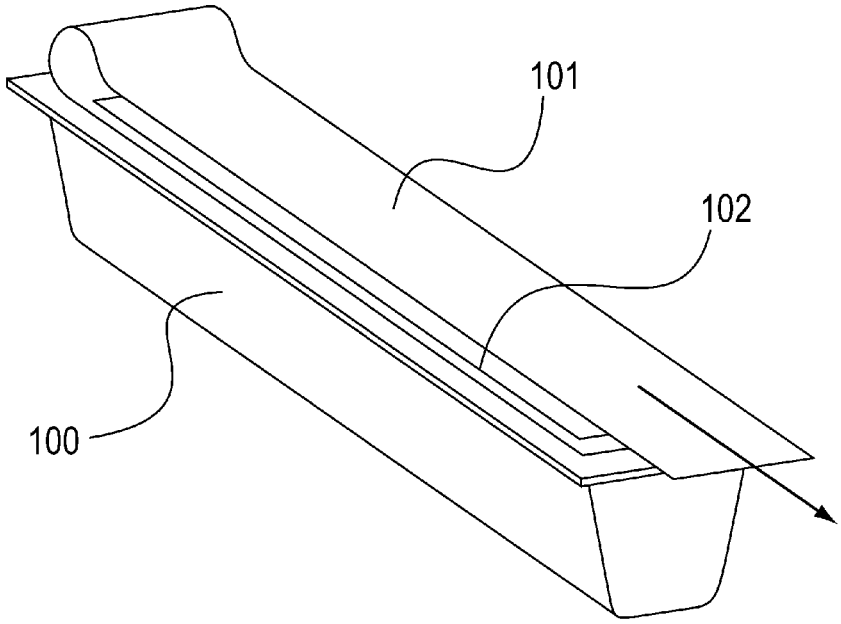

FIG. 14 is a perspective view for illustrating a conventional developer accommodating unit.

DESCRIPTION OF THE PREFERRED EMBODIMENTS

In the following description, a developer accommodating container refers to at least a flexibility container and a sealing member for sealing an opening, provided to the sealing member, for permitting discharge of a developer.

First Embodiment

Figure 2:
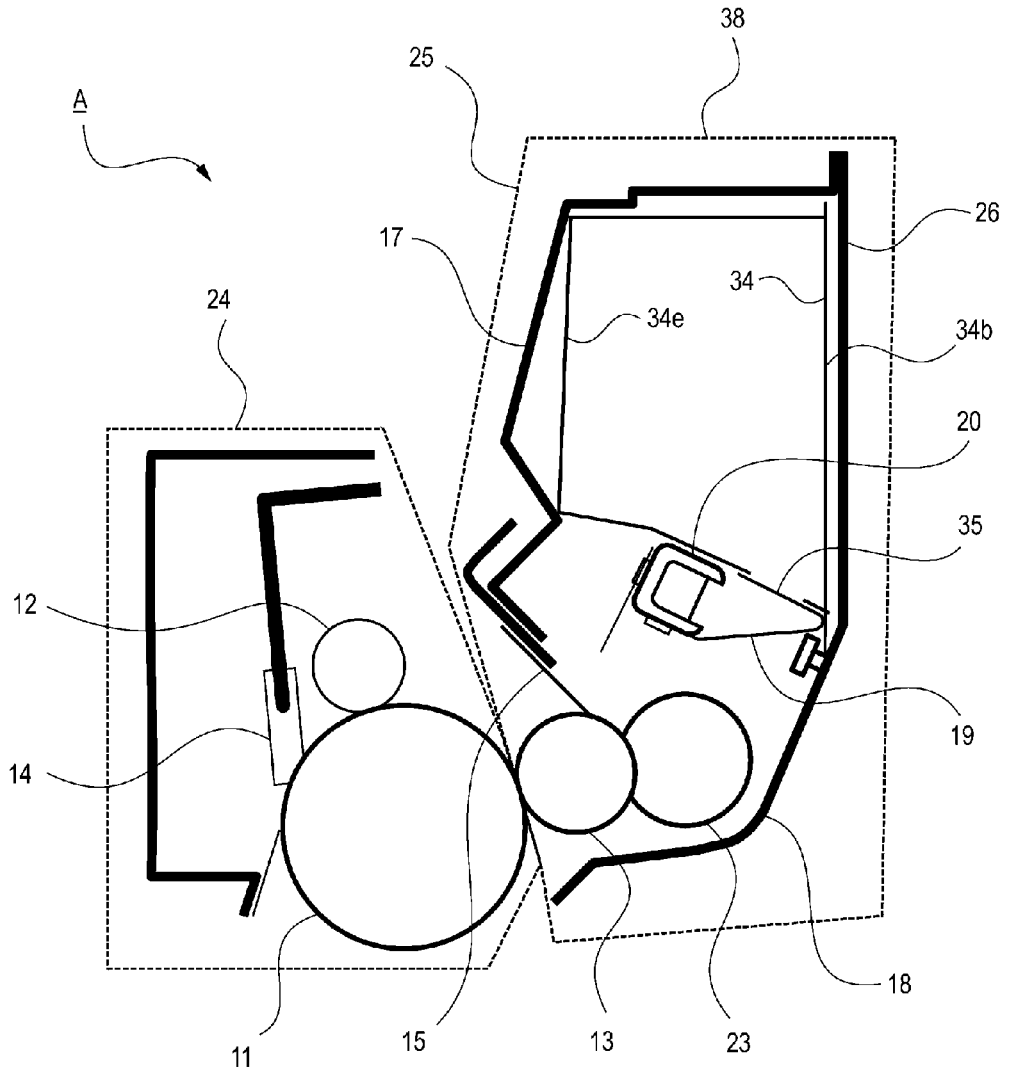
FIG. 2 is a principal sectional view of a process cartridge in First Embodiment of the present invention.
Figure 3:
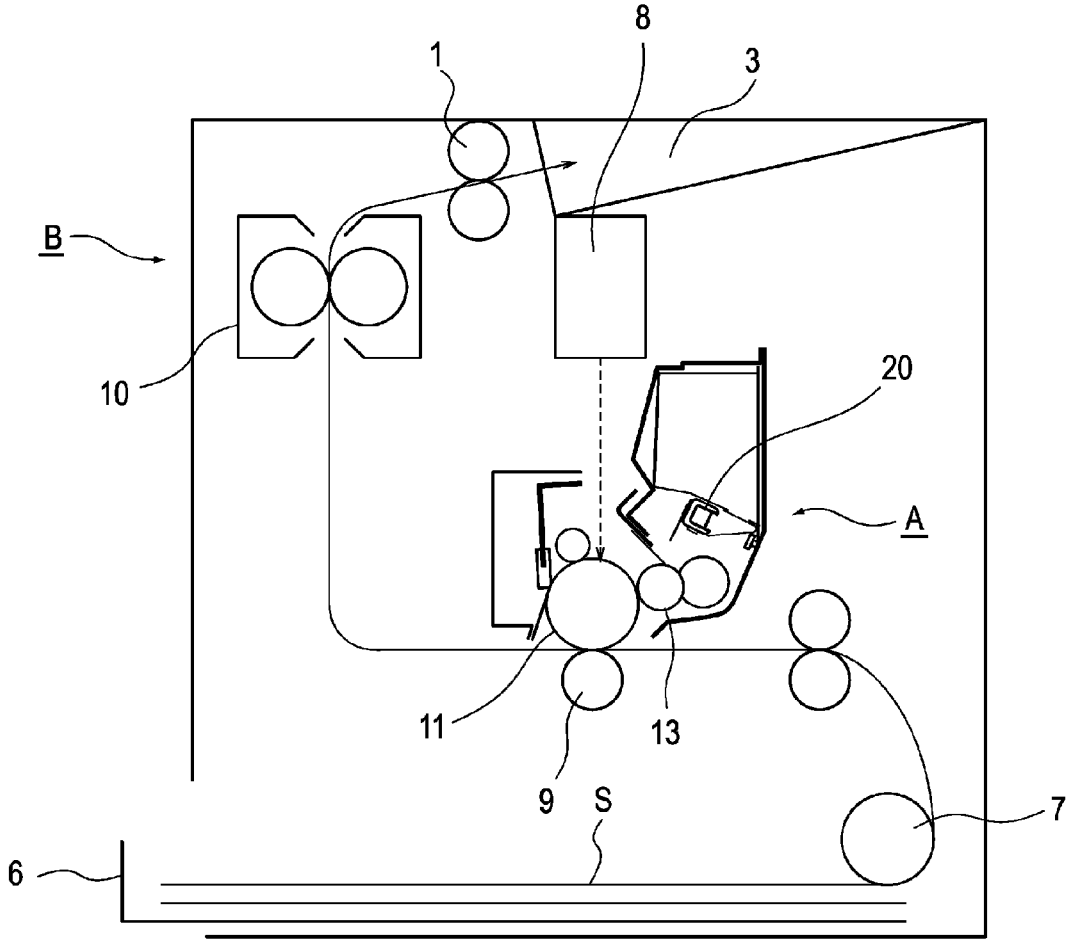
FIG. 3 is a principal sectional view of an image forming apparatus in First Embodiment of the present invention.

FIG. 2 is a principal sectional view of a process cartridge including the developer accommodating unit to which the present invention is applicable, and FIG. 3 is a principal sectional view of an electrophotographic image forming apparatus to which the present invention is applicable.

<Process Cartridge>

The process cartridge includes an image bearing member, which is an electrophotographic photosensitive member, and process means acting on the image bearing member and is detachably mountable to the image forming apparatus. Examples of the process means include a charging means for electrically charging a surface of the image bearing member, a developing device for forming an image on the image bearing member, and a cleaning means for removing a developer (toner, carrier, etc.) remaining on the image bearing member surface.

The process cartridge A in this embodiment includes, as shown in FIG. 2, includes a photosensitive drum 11 as the image bearing member and includes, at a periphery of the photosensitive drum 11, a charging roller 12 as the charging means and a cleaner unit 24 including an elastic cleaning blade 14 as the cleaning means. Further, the process cartridge A includes a developer accommodating unit 25 including a first frame 17 and a second frame 18. The process cartridge A is prepared by integrally assembling the cleaner unit 24 and the developer accommodating unit 25, and is constituted so as to be detachably mountable to an image forming apparatus main assembly B as shown in FIG. 3. A developing device 38 includes a developing roller (developer carrying member) 13 as the developing means, a developing blade 15, a developer supplying roller 23, and a developer accommodating container 26 including a developer accommodating member 34 which is a flexible container and including a sealing member 19. The developing roller 13 and the developing blade 15 are supported by the first frame 17.

<Image Forming Apparatus>

The process cartridge A is, as shown in FIG. 3, mounted in the image forming apparatus main assembly B and is used for image formation. In the image formation, a sheet S is fed by a feeding roller 7 from a sheet cassette 6 mounted at a lower portion of the apparatus and in synchronism with this sheet feeding, the photosensitive drum 11 is selectively exposed to light by an exposure device 8 to form a latent image. The developer is supplied to the developing roller 13 by the developer supplying roller 23 having a sponge shape and is carried in a thin layer on the surface of the developing roller 13. By applying a developing bias to the developing roller 13, the developer is supplied depending on the latent image and thus the latent image is developed into a developer image. This developer image is transferred onto the fed sheet S under bias voltage application to a transfer roller 9. The sheet S is conveyed to a fixing device 10, in which the image is fixed on the sheet S and then the sheet S is discharged to a discharge portion 3 at an upper portion of the apparatus.

<Developer Accommodating Unit>

Figure 4:
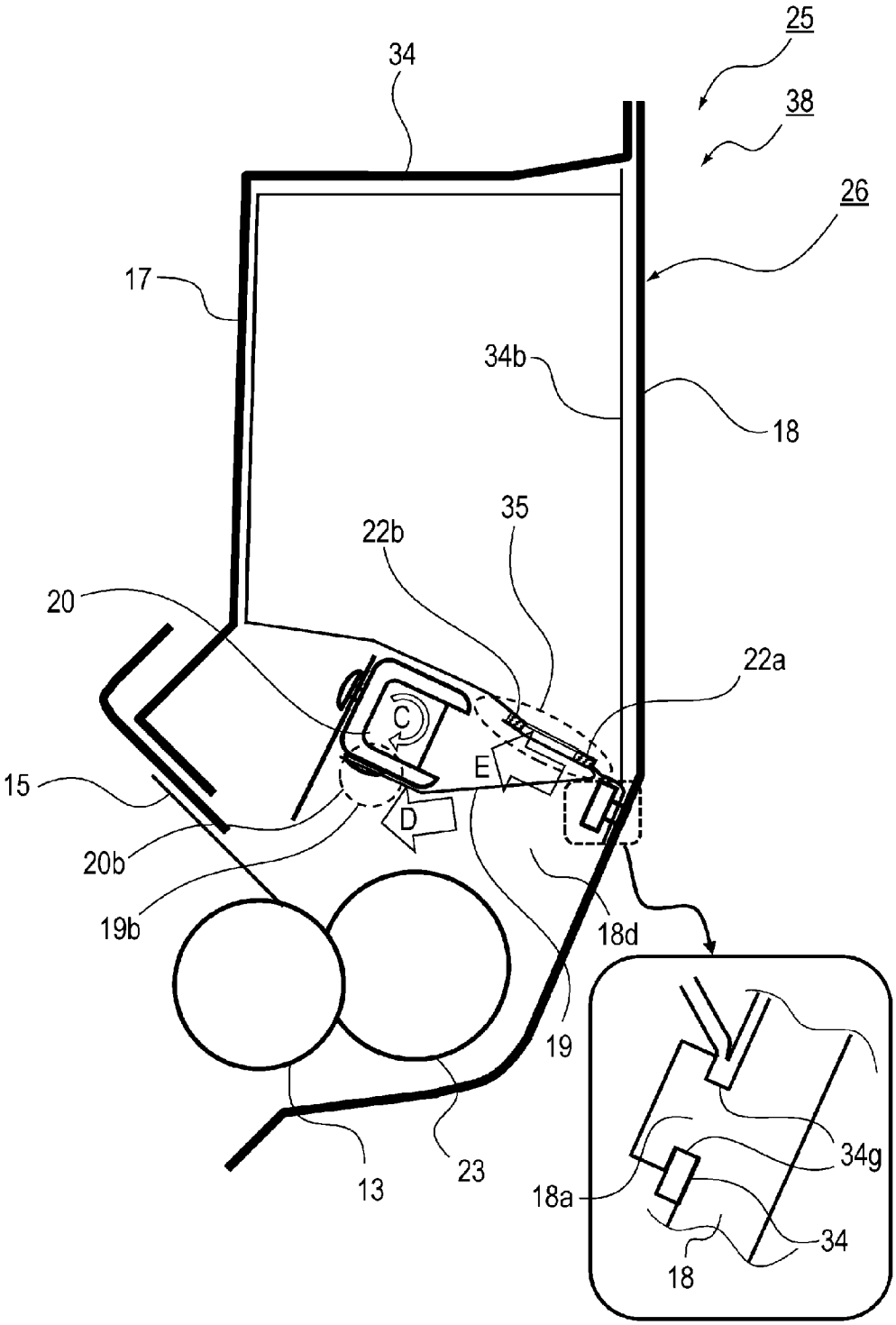
FIG. 4 is a sectional view of a developer accommodating unit in First Embodiment of the present invention.
Figure 5:
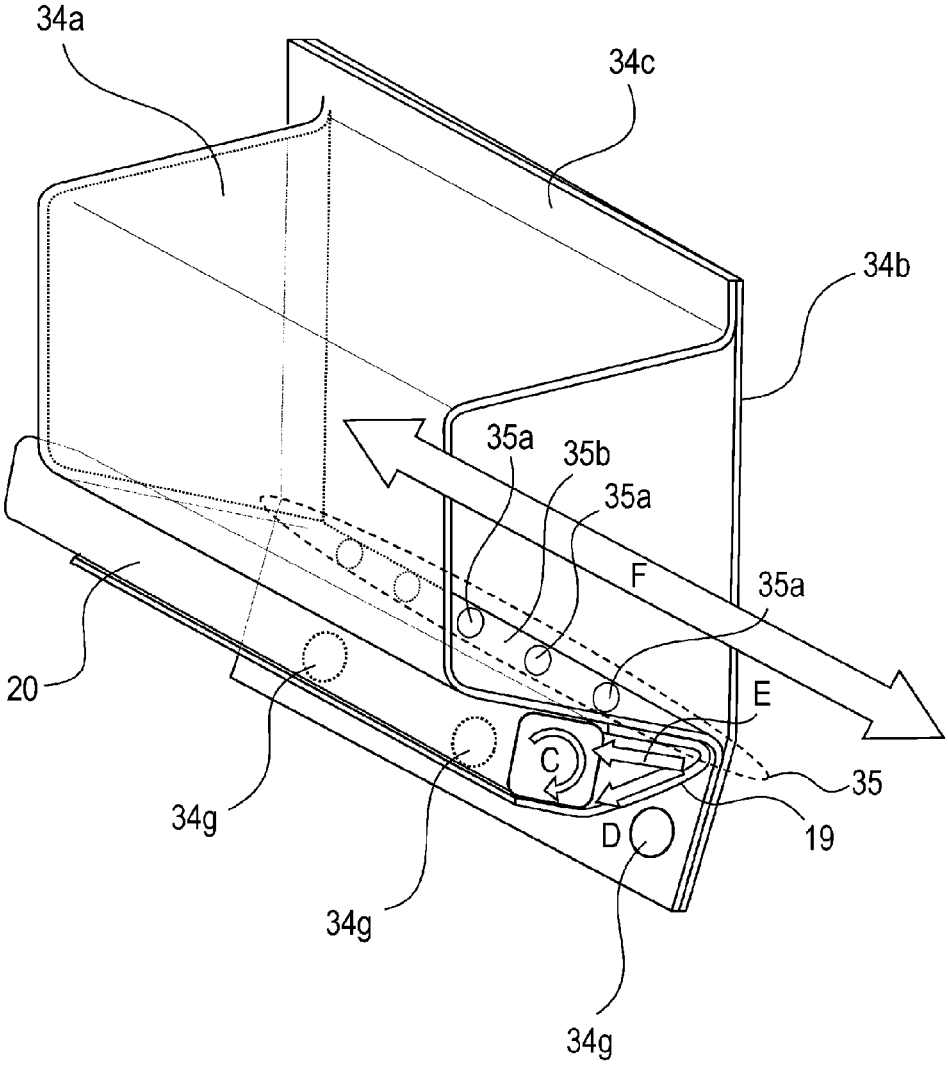
FIG. 5 is a perspective view of a developer accommodating container in First Embodiment of the present invention.

Next, a structure of the developer accommodating unit 25 will be described with reference to FIGS. 4 and 5. FIG. 4 is a sectional view of the developer accommodating unit 25 before unsealing, and FIG. 5 is a cut-away perspective view of the developer accommodating container 26.

The developer accommodating unit 25 in this embodiment is constituted, as shown in FIG. 4, by the developer accommodating container 26, the developing roller 13, the developing blade 15, and the first and second frames 17 and 18 for supporting these members. A combination of the first frame 17 and the second frame 18 constitute a frame for accommodating the developer accommodating container 26.

Incidentally, in this embodiment, the developer accommodating unit 25 is the same as the developing device 38. This is because the developer accommodating unit 25 includes the developing roller 13 and the developing blade 15. However, by supporting the developing roller 13 and the developing blade 15 by a frame which is separate from the developer accommodating unit 25, the developing roller 13 and the developing blade 15 may also be separated from the developer accommodating unit 25. In this case, the developing device 38 is constituted by the developer accommodating unit 25, the developing roller 13 and the developing blade 15.

(Developer Accommodating Container)

As shown in FIG. 5, the developer accommodating container 26 is constituted by the developer accommodating member 34, the sealing member 19 and the unsealing member 20 and is a flexible container in which a powdery developer is accommodatable. The developer accommodating member 34 is constituted by a molded portion 34*a* formed by subjecting a sheet-like member to vacuum molding, compressed-air molding or press molding, and a sheet-like air-permeable portion 34*b* through which a toner does not pass but the air can pass. Here, as a connecting method between the molded portion 34*a* and the air-permeable portion 34*b*, there are (thermal) welding, laser welding, adhesive bonding, adhesive tape bonding, and the like. At an outer peripheral portion 34*c* of the developer accommodating member 34, portions-to-be-fixed 34*g* for fixing the developer accommodating member 34 on the frame are partly provided. Further, the developer accommodating member 34 includes a discharging portion 35 where openings for permitting discharge of the developer are provided.

Before use of the process cartridge A, the sealing member 19 is connected to the developer accommodating member 34 so as to cover the discharging portion 35, so that the developer is sealed in the developer accommodating member 34. The sealing member 19 is constituted by a sheet-like member having flexibility, and includes a connecting portion connected to the developer accommodating member 34 so as to seal the openings. Further, the sealing member 19 is peeled (pulled) off from the developer accommodating member 34 at the time of start of the use of the process cartridge A, so that the connecting portion is removed (peeled) to expose the openings, and thus the developer is dischargeable from the developer accommodating container 26.

Figure 1:
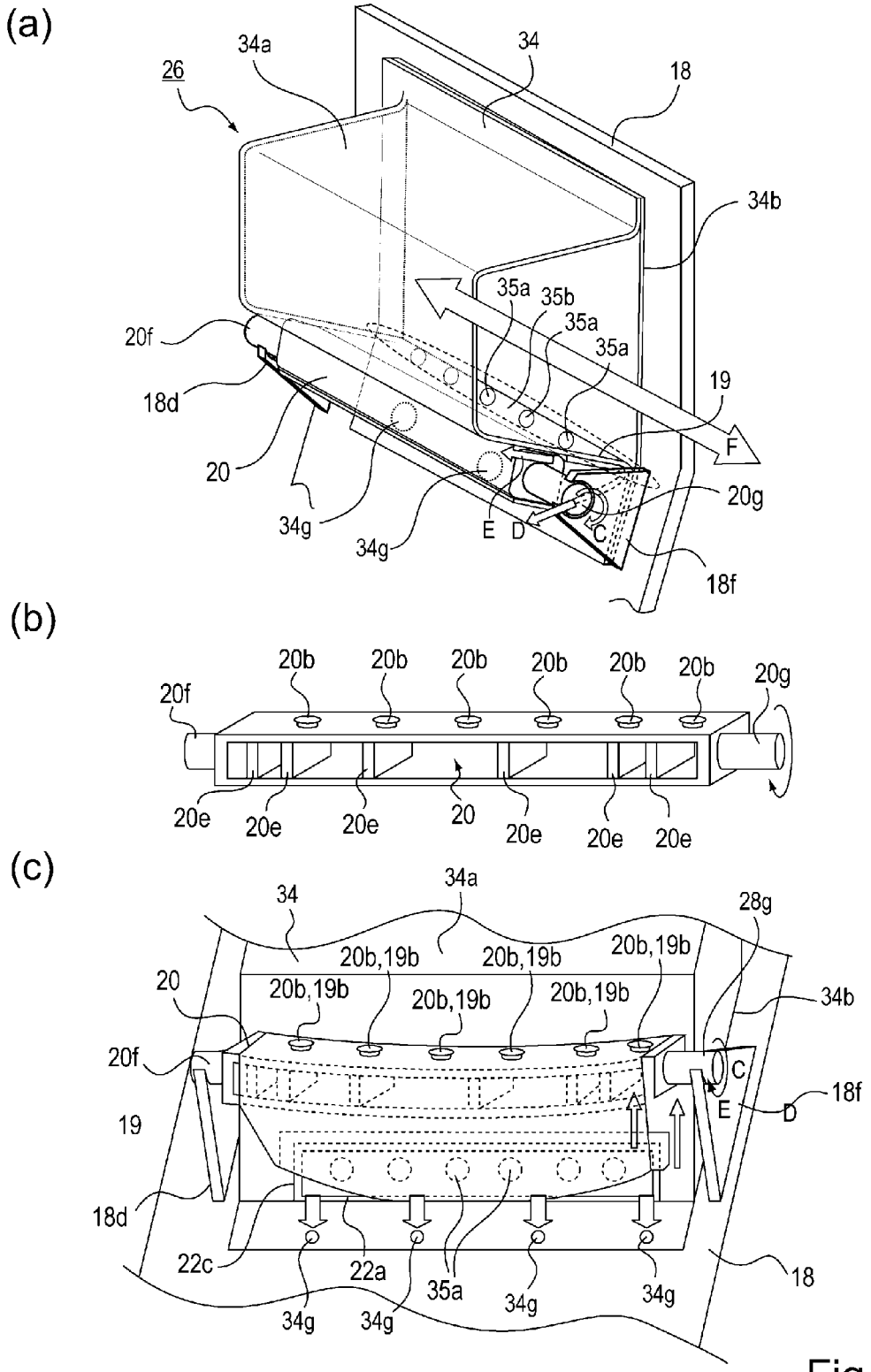

Further, as shown in FIG. 4, the sealing member 19 is connected with the unsealing member 20 at a portion-to-be-engaged 19*b*, and the unsealing member 20 is rotatably supported by a first supporting portion 18*d* and a second supporting portion 18*f*, which are shown in FIG. 1 and are described later, of the second frame 18. The unsealing member 20 includes a rotation shaft with respect to a direction perpendicular to a movement direction of the sealing member 19, and by an unshown driving means provided in the image forming apparatus main assembly B, a driving force is transmitted to the unsealing member 20, so that the unsealing member 20 is rotated in an arrow C direction. As a result, it becomes possible to wind up the sealing member 19 to expose the discharging portion 35.

As shown in FIG. 4, the developer accommodating container 26 is fixed by portions-to-be-fixed 34*g* in an inside space formed by the first frame 17 and the second frame 18. Here, the discharging portion 35 may preferably be configured so that the accommodated developer is easily discharged in its attitude during image formation. For that reason, in the attitude during the image formation, the discharging portion 35 is disposed so as to be directed downward with respect to the vertical direction. Further, as shown in FIG. 4, the openings of the developer accommodating member 34 are provided at a lower portion of the bottom of the developer accommodating member 34, whereby the accommodated developer is usable without remaining in the developer accommodating member 34.

(Discharging Portion)

Figure 6A:
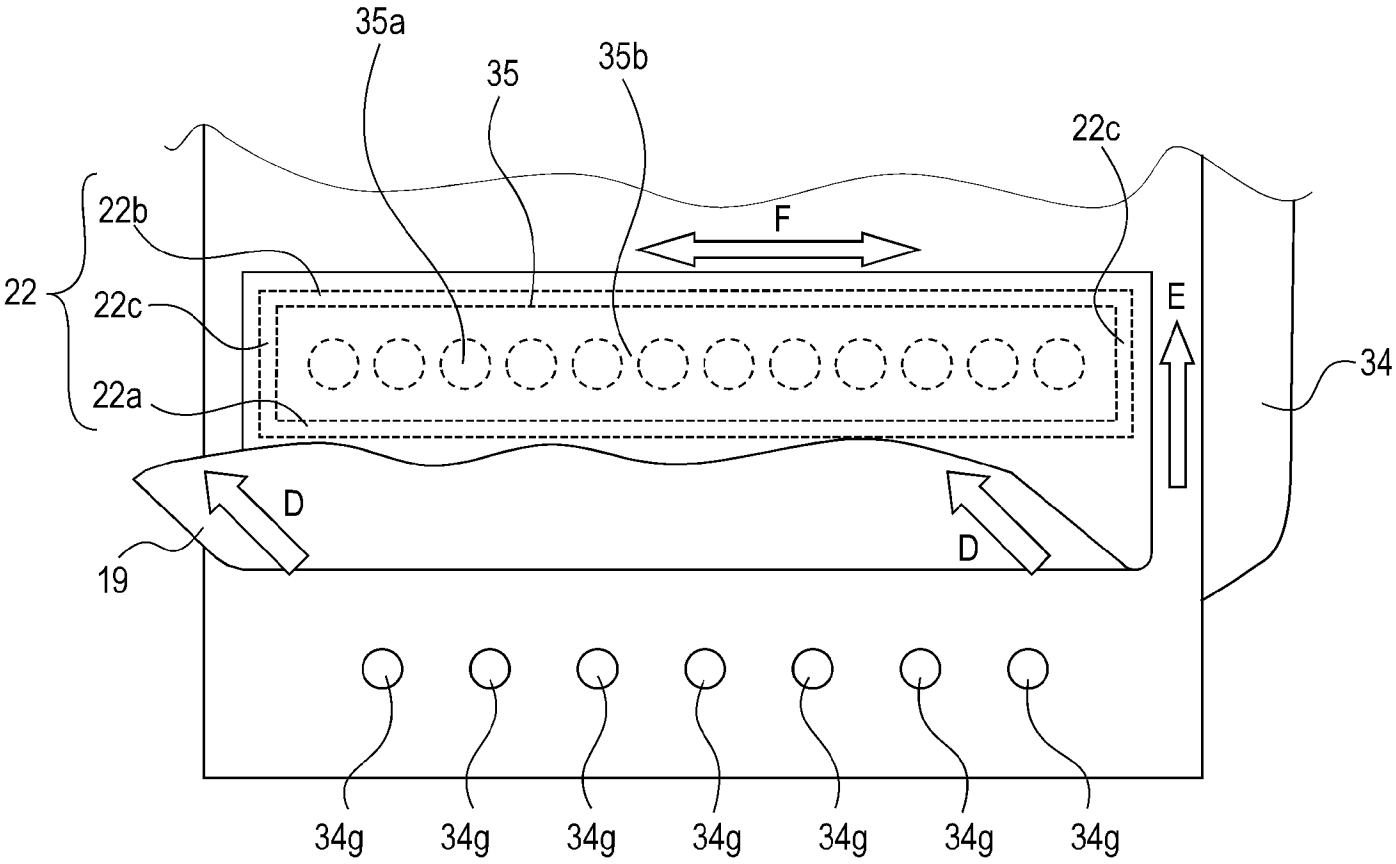
FIGS. 6A and 6B are detailed illustrations each showing a discharging portion and its peripheral portion in First Embodiment of the present invention.
Figure 6B:
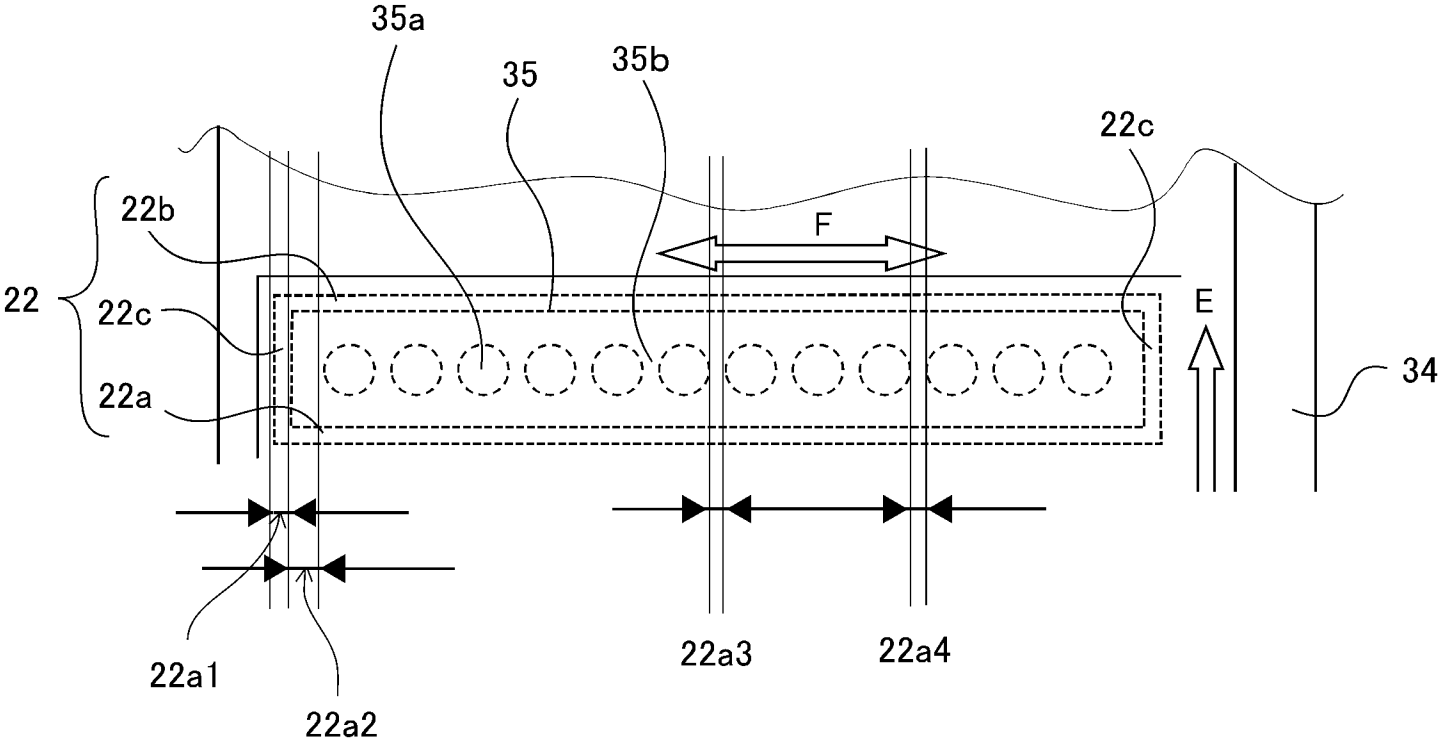

Next, a structure of the discharging portion 35 will be described with reference to FIGS. 6A and 6B. FIGS. 6A and 6B are detailed views each showing the discharging portion 35 provided to the developer accommodating member 34 and its peripheral portion.

A state in which the sealing member 19 is bonded to the developer accommodating member 34 is shown. The sealing member 19 seals openings 35*a* provided at the molded portion 34*a* and exposes the openings 35*a* by being moved. A movement direction (in which the sealing member 19 is pulled by the unsealing member 20) of the sealing member 19 is an arrow direction D. By the movement of the sealing member 19, the connecting portion is peeled, so that the exposure of the openings 35*a* in an unsealing direction E is advanced.

As shown in FIG. 6A, the discharging portion 35 is constituted by the openings 35*a* formed as a plurality of holes for permitting discharge of the inside developer, and connection portions 35*b* for connecting the plurality of openings 35*a*. The openings 35*a* and the connection portions 35*b* are disposed in line in a direction perpendicular to the unsealing direction E.

Each of the plurality of openings 35*a* in First Embodiment has a round shape. Further, the discharging portion 35 is continuously surrounded by a connecting portion (bonding portion) 22 of the sealing member 19, and the sealing member 19 is unsealable connected to the discharging portion 35 to seal the discharging portion 35 of the developer accommodating member 34 in which the developer is accommodated.

As shown in FIG. 6A, the connecting portion 22 enables the sealing of the discharging portion 35 by being shaped in a rectangular shape constituted by continuously connecting two linear bonding portions extending in a long direction (arrow F direction) and two linear bonding portions extending in a short direction (arrow E direction) so as to surround the discharging portion 35. Of the two connecting portions 22 welded with respect to the long direction (arrow F direction), an early unsealed portion is referred to as a connecting portion A (22*a*) and a late unsealed portion is referred to as a connecting portion B (22*b*). The connecting portion A (22*a*) includes a first connecting portion and a second connecting portion, and the connecting portion B (22*b*) opposes the connecting portion A (22*a*) via the openings 35*a*. Further, the connecting portion 22 extending in the short direction (arrow E direction) is referred to as a widthwise (short-side) connecting portion 22*c*. In this embodiment, the unsealing direction is the arrow E direction. The unsealing direction is defined as follows. In the case where the unsealing is performed by moving the sealing member 19, of the connecting portion A (22*a*) and the connecting portion B (22*b*) between which the openings 35*a* are interposed, the connecting portion A (22*a*) is early unsealed (peeled). At that time, unsealing timing is different between the first connecting portion and the second connecting portion, so that the first connecting portion is early peeled (unsealed). The first connecting portion may be, as shown in FIG. 6B, e.g., a region 22*a*1 of the connecting portion A overlapping with the widthwise connecting portion 22*c*, a region 22*a*2 interposed between the widthwise connecting portion 22*c* and the opening 35*a* disposed in a leftmost side, or a combination of these regions (22*a*1+22*a*2). On the other hand, the second connecting portion may be a region 22*a*3 located at a longitudinal central portion of the connecting portion A or a region 22*a*4 interposed between the openings 35*a* disposed in a right side. Further, the linear bonding portions extend in the longitudinal direction of the connecting portions but may also extend in a direction which is not parallel to the longitudinal direction but is an oblique direction. Similarly, in this embodiment, the connecting portion has the linear shape but the shape thereof is not limited to the linear shape.

<Unsealing Member>

The unsealing member 20 in this embodiment will be specifically described with reference to FIGS. 1 and 4 in combination with FIG. 7. Parts (a) to (c) of FIG. 1 are illustrates each showing the unsealing member 20 and its peripheral portion. Parts (a) and (b) of FIG. 7 are perspective views each showing another shape of the unsealing member 20.

The unsealing member 20 is used for the purpose of moving the sealing member 19 to be peeled off from the developer accommodating member 34. In the following, the unsealing member 20 will be described with reference to FIG. 1. Part (a) of FIG. 1 is a perspective view showing an arrangement relationship among the unsealing member 20, the discharging portion 35, the sealing member 19, and the first and second supporting portions 18*d* and 18*f* provided on the second frame 18. Part (b) of FIG. 1 is an illustration showing the shape of the unsealing member 20, and (c) of FIG. 1 is an illustration showing a state in which the sealing member 19 is in the midstream of unsealing by the unsealing member 20.

As shown in (a) and (b) of FIG. 1 and FIG. 4, the unsealing member 4 has a shaft shape longer than a width of the sealing member 19, and is rotatably supported by the first and second supporting portions 18*d* and 18*f* at portions-to-be-supported 20*f* and 20*g*, respectively, in end sides with respect to a rotational axis direction thereof.

In this embodiment, as shown in (b) and (c) of FIG. 1, the unsealing member 20 has a U-shape in cross section and has an engaging surface including an engaging portion 20*b* to be engaged with the sealing member 19 and an opposing surface opposing the engaging surface. Further, between the engaging surface and the opposing surface, a plurality of reinforcing portions for reinforcing the unsealing member 20 are provided. The plurality of reinforcing portions may preferably be disposed at intervals, and may also be increased in the number thereof in order to enhance strength thereof. In (b) of FIG. 1, the intervals between the reinforcing portions are small at end portions and are large at a central portion, and therefore the strength is larger at the end portions than at the central portion. Here, the shape of the unsealing member 20 may also be, in addition to the U-shape in cross section, an H-shape in cross section ((a) of FIG. 7), a rectangular (frame-) shape (in which a hallow portion is provided) in cross section ((b) of FIG. 7), and the like.

Further, the unsealing member 20 is constituted by a material having elasticity. As the material, e.g., a mold of polyacetal (POM), polystyrene (PS), ABS resin, or the like is used. Incidentally, the shape and material of the unsealing member 20 may only be required that the unsealing member 20 compatibly realizes positive flexure against peeling strength of the sealing member 19 and sufficient breaking strength, and therefore may appropriately be selected in view of a balance between the flexure and the breaking strength at that time.

<Unsealing of Developer Accommodating Member>

The unsealing of the developer accommodating member 34 will be described with reference to FIGS. 8 and 9*d*. Parts (a) to (c) of FIG. 8 are enlarged sectional views for illustrating an unsealing process of the unsealing member 20. In (a) to (c) of FIG. 8, the supporting portion 18*d* of the first frame 18 rotatably supporting the unsealing member 20 at each of the end portions of the unsealing member 20 is not illustrated. Part (a) of FIG. 8 shows a rest state of the unsealing member 20 before the connecting portion A (22*a*) is peeled, and (b) of FIG. 8 shows a rotation state of the unsealing member immediately before the connecting portion A (22*a*) is peeled. Further, (c) of FIG. 8 shows a rotation state of the unsealing member 20 after the connecting portion A (22*a*) is peeled. FIG. 9 is an illustration of a flexure model of a simple beam on which a uniform load acts.

In this embodiment, as shown in (a) of FIG. 8, the portions-to-be-fixed 34*g* of the developer accommodating member 34 are bonded and fixed to the fixing portion 18*a* of the second frame 18 by ultrasonic clamping. Further, for unsealing of the sealing member 19, the unsealing member 20 is rotated to pull and wind the sealing member 19 around the unsealing member 20 to peel off the sealing member 19 from the openings 35*a*.

That is, for the unsealing, as shown in (b) of FIG. 8, a driving force is transmitted from the main assembly to the unsealing member 20 by an unshown driving means, so that the unsealing member 20 is rotated in an arrow C direction. Then, the unsealing member 20 is further rotated to pull the sealing member 19, so that the unsealing of the connecting portion A (22*a*) is started. With the rotation, the sealing member 19 is pulled in the arrow D direction by a corner portion 20*c* (force application point portion 20*a*) of the unsealing member 20.

When the sealing member 19 is pulled, the developer accommodating member 34 is pulled via the connecting portion A (22*a*). Then, a force is applied to the portions-to-be-fixed 34*g*, so that the developer accommodating member 34 is further pulled by the fixing portion 18*a*. Then, as shown in (c) of FIG. 1, portions-to-be-supported 20*f* and 20*g* of the unsealing member 20 having elasticity are supported by the first and second supporting portions 18*d* and 18*f*, respectively, at the end portions with respect to the rotational axis direction, and therefore flexure of the unsealing member 20 occurs with respect to a direction perpendicular to a direction in which the exposure of the openings 35*a* advances, i.e., the rotational axis direction.

The flexure has the same system as a flexure model of a single beam on which a uniform load acts. Therefore, a flexure amount of the unsealing member 20 can be calculated from equations shown below. Here, L is a full length of the beam, $_X$ is a beam length from a beam-supported position, I is geometrical moment of inertia, E is Young's modulus, and w is load per unit length.

A flexure amount va of the unsealing member 20 at the central portion with respect to the rotational axis direction is obtained by formula 1 below.

$$va=(5wL^4)/(384EI) \quad \text{(formula 1)}$$

Further, a flexure amount vb of the unsealing member 20 at each of the end portions with respect to the rotational axis direction is obtained by formula 2 below.

$$vb=(w_X)(L^2+2L_X{}^2+_X)^2/(24EI) \quad \text{(formula 2)}$$

Here, with respect to the flexure amount at the end portion of the unsealing member 20 with respect to the rotational axis direction, the unsealing member 20 is supported by the first and second supporting portions 18*d* and 18*f* and therefore $_X$=0, so that vc=0. As a result, a relationship between vb and va is represented by formula 3 below.

$$vc=0<(5wL^4)/(384EI)=va \quad \text{(formula 3)}$$

Further, the sealing member 19 is fixed to the unsealing member 20 by engaging the portion-to-be-engaged 19*b* of the sealing member 19 with the engaging portion 20*b* of the unsealing member 20. At this time, in this embodiment, as shown in (a) of FIG. 8, the engaging portion 20*b* is provided so that the corner portion 20*c* which is an open portion of the U-shaped unsealing member 20 is the force application point portion 20*a* during the unsealing. For that reason, when the unsealing member 20 is rotated and is pulled in an opposite direction to the arrow D direction by the sealing member 19, the surface of the unsealing member 20 where the engaging portion 20*b* is provided tends to be easily flexed in the opposite direction to the arrow D direction.

Therefore, the central portion of the unsealing member 20 with respect to the rotational axis direction is peeled larger than the end portions of the unsealing member 20 supported by the first supporting portion 18*d* and the second supporting portion 18*f* ((c) of FIG. 1). As a result, the end portions of the sealing member 19 with respect to the widthwise direction (the rotational axis direction of the unsealing member 20) is, since the flexure amount of the unsealing member 20 at the end portions is small, moved in an amount larger at the end portions than at the central portion by the rotation of the unsealing member 20.

Therefore, by the rotation of the unsealing member 20, the first connecting portion at each of the end portions of the unsealing member 20 with respect to the rotational axis direction is peeled earlier than the second connecting portion at the central portion of the unsealing member 20 ((c) of FIG. 1). Then, when the unsealing is further advanced by the rotation of the unsealing member 20, the peeling spreads from the first connecting portion of the connecting portion A (22*a*) at each of longitudinal the end portions to the second connecting portion of the connecting portion A (22*a*) at the longitudinal central portion, so that the peel of the connecting portion A (22*a*) is completed.

Then, when the unsealing member 20 is further rotated, the peeling of the connecting portion B (22*b*) is performed. Also when the peeling of the connecting portion B (22*b*) is performed, similarly as when the connecting portion A (22*a*) is peeled, the unsealing member 20 is smaller in flexure amount at the end portions than at the central portion with respect to the rotational axis direction. For that reason, the movement amount of the sealing member 19 by the unsealing member 20 is larger at the end portions of the unsealing member 20 than at the central portion of the unsealing member 20. Therefore, also at the connecting portion B (22*b*), with advance of the rotation of the unsealing member 20, the end portions of the unsealing member 20 with respect to the rotational axis direction are peeled earlier than the central portion. That is, the peeling of the connecting portion B (22*b*) is started first from the first connecting portion and then is performed at the central second connecting portion.

Thus, the constitution in which the elasticity is imparted to the unsealing member 20 and the sealing member 19 is unsealed while positively flexing the central portion of the unsealing member 20 with respect to the rotational axis direction is employed. As a result, with respect to the direction (the longitudinal direction of the connecting portions 22*a* and 22*b*) perpendicular to the direction in which the exposure of the openings 35*a* advances, timing of the unsealing can be shifted.

Therefore, it is possible to suppress the pulling of the sealing member 19 performed at once by the unsealing member 20 during the unsealing. As a result, a torque load exerted on the motor of the image forming apparatus main assembly during the unsealing can be reduced and therefore a small-sized motor can be used, so that the cost can be reduced. Further, deformation of the openings 35*a* of the developer accommodating member 34 can be suppressed, so that the openings 35*a* can be unsealed with reliability.

Second Embodiment

Second Embodiment will be described. In this embodiment, a constitution different from the constitution of the unsealing member 20 in First Embodiment is employed, and in this embodiment a different portion of the constitution different from that in First Embodiment will be described and thus the same constitution portion (another portion) will be omitted from the description.

<Unsealing Member>

Parts (a) and (b) of FIG. 10 are illustrations each showing the unsealing member 20 and its peripheral portion. Part (a) of FIG. 10 is a perspective view showing an arrangement relationship among the unsealing member 20, the discharging portion 35, the sealing member 19 and the supporting portion 18*d* provided on the second frame 18. Part (b) of FIG. 10 is an illustration showing a structure of the unsealing member 20.

The unsealing member 20 in this embodiment has, as shown in (b) of FIG. 10, a so-called D-cut shape such that a cross section with respect to an axial direction has a single flat plane. Further, with respect to the rotational axis direction of the unsealing member 20, the unsealing member 20 is configured so that a circumferential with respect to the rotational direction becomes longer from the central portion toward the end portions supported by the first and second supporting portions 18*d* and 18*f*. That is, an outer shape at an end portion A and an outer shape at a central portion B are different from each other, and a cross-sectional area A of the end portion A is larger than a cross-sectional area B.

Incidentally, the material for the unsealing member 20 in this embodiment may have elasticity or rigidity. For example, as the material having elasticity, a mold of POM, PS or ABS may be used. As the material having rigidity, metal such as stainless steel or iron may be used.

<Unsealing of Developer Accommodating Member (Bag)>

The unsealing operation of the developer accommodating member 34 will be described with reference to FIGS. 11 and 12. Parts (a) to (d) of FIG. 11 are sectional views taken along A-A lines indicated in (b) of FIG. 10 and illustrate an unsealing process of the unsealing member 20 at each of the end portions with respect to the rotational axis direction. Parts (a) to (d) of FIG. 12 are sectional views taken along B-B line indicated in (b) of FIG. 10 and illustrate an unsealing process of the unsealing member 20 at the central portion with respect to the rotational axis direction. Further, each of pairs of (a) of FIG. 11 and (a) of FIG. 12, (b) of FIG. 11 and (b) of FIG. 12, (c) of FIG. 11 and (c) of FIG. 12, and (d) of FIG. 11 and (d) of FIG. 12 shows the same timing state in which the unsealing member 20 is in the same rotation state.

Incidentally, phantom points S and M show a position of a bent portion 19*d* of the sealing member 19 at the times of (a) of FIG. 11 and (a) of FIG. 12, respectively. With the pulling of the sealing member 19 by the rotation of the unsealing member 20, also the phantom points S and M are moved. Further, phantom points R and N show the position of the bent portion 19*d* at the times of (a) of FIG. 11 and (a) of FIG. 12, respectively, and are not moved. A length connecting the phantom points S and R is G, and a length connecting the phantom points M and N is H.

In (b) of FIG. 11, the corner portion 20*c*1 of the unsealing member 20 is the force application point portion 20*a*, and in (b) of FIG. 12, the corner portion 20*c*2 is the force application point portion 20*a*. The developer accommodating member 34 is fixed to the second frame 18 similarly as in First Embodiment.

First, the unsealing member 20 is rotated in the arrow C direction by the transmission of the driving force from the main assembly by the unshown driving means. Then, a state immediately before start of the unsealing of the connecting portion A (22*a*) by further rotation of the unsealing member 20 to pull the sealing member 19 is shown in (b) of FIG. 11 and (b) of FIG. 12.

As shown in (b) of FIG. 11, at the end portions of the unsealing member 20 with respect to the rotational axis direction, the sealing member 19 is pulled in the arrow D direction by the corner portion 20*c*1 (force application point portion 20*a*) of the unsealing member 20. At this time, the unsealing member 20 is increased in circumferential from the central portion toward the end portions with respect to the rotational axis direction. For that reason, as shown in (b) of FIG. 12, at the central portion of the unsealing member 20 with respect to the rotational axis direction, the corner portion 20*c*2 (force application point portion 20*a*) of the unsealing member 20 does not contact the unsealing member 19, so that the sealing member 19 is not pulled in the arrow D direction at the central portion.

The movement amount of the sealing member 19 by the rotation of the unsealing member 20 is larger at the end portions than at the central portion with respect to the rotational axis direction of the unsealing member 20. This is because the circumferential of the unsealing member 20 is longer in the neighborhood of the end portions than at the central portion with respect to the rotational axis direction of the unsealing member 20 and therefore the sealing member 19 is wound up in a larger amount at the end portions than at the central portion. Therefore, as shown in (c) of FIG. 11, (d) of FIG. 11, (c) of FIG. 12 and (d) of FIG. 12, the length G in (c) of FIG. 11 is longer than the length H in (c) of FIG. 12, and the length G in (d) of FIG. 11 is longer than the length H in (d) of FIG. 12. Further, a difference between the length G and the length H is the same as a difference in circumferential of the unsealing member between the end portion and the central portion. Therefore, the first connecting portion at the end portions of the unsealing member 20 is peeled earlier than the second connecting portion at the central portion of the unsealing member 20.

Then, when the unsealing member 20 is further rotated, the peeling spreads from the end portions of the unsealing member 20 toward the central portion of the unsealing member 20 and thus the central portion is finally peeled, so that the peeling of the connecting portion A (22*a*) is completed.

Then, the peeling of the connecting portion B (22*b*) is similarly performed from the end portions toward the central portion with respect to the rotational axis direction of the unsealing member 20.

As described above, by constituting the unsealing member 20 so that the circumferential of the unsealing member 20 becomes longer from the central portion toward the end portions with respect to the rotational axis direction, even when the unsealing member 20 is the rigid member, unsealing timing can be shifted with respect to the direction perpendicular to the direction in which the exposure of the openings 35*a* advances.

Therefore, it is possible to reduce a degree of the pulling of the sealing member 19 performed at once by the unsealing member 20 during the unsealing and therefore the deformation of the openings 35*a* of the developer accommodating member 34 can be suppressed, so that the openings 35*a* can be unsealed with reliability. Further, by shifting the timing of the unsealing, the torque load exerted on the motor of the image forming apparatus main assembly during the unsealing can be reduced, so that the unsealing can be performed with reliability.

Third Embodiment

In the above-described embodiments, the case where the developer accommodating member for accommodating the developer is the flexible container is illustrated, but the developer accommodating member is also applicable even when the developer accommodating member has no flexibility.

FIG. 13 is a sectional view showing a structure in which the developer accommodating member 34 having the flexibility is not used. As shown in FIG. 13, the developer is directly accommodated in a space defined by the first frame 17 and the second frame 18, and therefore the developer accommodating member is constituted by the first frame 17 and the second frame 18. Further, a constitution in which the first frame 17 is provided with an opening 35*a* constituting the discharging portion 35 of the developer, and the sealing member 19 for sealing the opening 35*a* is bonded to the first frame 18, which is a rigid member, via the connecting portion 22 is employed.

Further, the sealing member 19 is mounted on the unsealing member 20 rotationally supported by the supporting portion 18*d* of the first frame 18 at its end portions. The unsealing member 20 is formed of the elastic material as described above and is rotatably supported at its end portions by the supporting portion 18*d* provided on the second frame 18.

Also in this case, it becomes possible to perform the unsealing while positively flexing the unsealing member 20 at the central portion, and thus the unsealing timing can be shifted in the direction perpendicular to the direction in which the exposure of the opening 35*a* advances, so that effects similar to those in the above-described embodiments can be obtained.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 113246/2012 and 097299/2013 filed May 17, 2012 and May 7, 2013, respectively, which are hereby incorporated by reference.

What is claimed is:

1. A developer accommodating unit comprising:

a developer accommodating member, provided with an opening for permitting discharge of developer, for accommodating the developer;

a sealing member including a connecting portion for being connected to said developer accommodating member so as to seal the opening; and an unsealing member for exposing the opening by moving said sealing member to peel said connecting portion from said developer accommodating member in an unsealing direction, wherein said connecting portion includes a first connecting portion and a second connecting portion with respect to a longitudinal direction thereof crossing the unsealing direction, and wherein, when said connecting portion is peeled from said developer accommodating member, said unsealing member sags so that said first connecting portion is peeled before said second connecting portion.

2. A developer accommodating unit according to claim 1, wherein said unsealing member sags more at its central portion than at its end portion.

3. A developer accommodating unit according to claim 1, wherein said unsealing member includes an engaging surface where said unsealing member is engaged with said sealing member and an opposing surface opposing said engaging surface, and wherein said unsealing member includes a reinforcing portion for reinforcing said engaging surface and said opposing surface.

4. A developer accommodating unit according to claim 3, wherein said reinforcing portion is provided at a plurality of positions intervals.

5. A developer accommodating unit according to claim 4, wherein the interval at a central portion is wider than the interval at an end portion.

6. A developer accommodating unit according to claim 1, wherein said unsealing member has a cross section in one of a U shape, a rectangular shape, and an H shape.

7. A developer accommodating unit according to claim 1, wherein said first connecting portion is located at an end portion of said connecting portion, and said second connecting portion is located at a central portion of said connecting portion.

8. A developer accommodating unit according to claim 1, wherein said first connecting portion is located at each of end portions of said connecting portion.

9. A developer accommodating unit according to claim 1, wherein said connecting portion includes a portion linearly bonded to said developer accommodating member.

10. A developer accommodating unit according to claim 9, wherein the portion linearly bonded to said developer accommodating member linearly extends in the longitudinal direction of said connecting portion.

11. A developer accommodating unit according to claim 1, wherein said developer accommodating member is a flexible container.

12. A developer accommodating unit according to claim 11, wherein said flexible container is accommodated in an inside space formed by a plurality of frames.

13. A developer accommodating unit according to claim 1, wherein said developer accommodating member is constituted by a plurality of frames, and at least one of said frames is provided with the opening.

14. A developer accommodating unit according to claim 1, wherein said unsealing member is rotated to peel said sealing member.

15. A developer accommodating unit according to claim 1, wherein said unsealing member is supported by a supporting portion at its end portions.

16. A developer accommodating unit according to claim 1, wherein the unsealing direction is perpendicular to the longitudinal direction of said connecting portion.

17. A developer accommodating unit according to claim 1, wherein the opening is provided at a plurality of positions.

18. A developer accommodating unit according to claim 1, wherein said unsealing member has a hollow portion therein.

19. A developing device comprising:

a developer accommodating unit according to claim 1, and a developer carrying member for carrying the developer discharged from said developer accommodating unit.

20. A process cartridge comprising:

a developer accommodating unit according to claim 1; and an image bearing member for bearing a developer image formed by using the developer discharged from said developer accommodating unit.

21. An image forming apparatus comprising:

a developer accommodating unit according to claim 1 detachably mountable to a main assembly of said image forming apparatus, wherein an image is formed on a sheet by using the developer discharged from said developer accommodating unit.

22. A developer accommodating unit comprising:

a developer accommodating portion, provided with an opening for permitting discharge of developer, for accommodating the developer;

a sealing member including a connecting portion for being connected to said developer accommodating portion so as to seal the opening;

an unsealing member for exposing the opening by moving said sealing member to peel said connecting portion from said developer accommodating portion, and a frame, including said developer accommodating portion, for accommodating said unsealing member therein, wherein said connecting portion includes a first connecting portion and a second connecting portion with respect to a longitudinal direction thereof, and wherein, when said connecting portion is peeled from said developer accommodating portion in a direction crossing the longitudinal direction, said unsealing member sags so that said first connecting portion is peeled before said second connecting portion.

23. A developer accommodating unit according to claim 22, wherein the direction crossing the longitudinal direction is perpendicular to the longitudinal direction of said connecting portion.

24. A developing device comprising:

a frame for accommodating developer;

a developer carrying member for carrying the developer;

a sealing member including a connecting portion for being connected to said developer carrying member so as to seal an opening for permitting supply of the developer to said developer carrying member; and an unsealing member for exposing the opening by moving said sealing member to peel said connecting portion from said developer accommodating portion, wherein said unsealing member is accommodated inside said frame, wherein said connecting portion includes a first connecting portion and a second connecting portion with respect to a longitudinal direction thereof, and wherein, when said connecting portion is peeled in a direction crossing the longitudinal direction, said unsealing member sags so that said first connecting portion is peeled before said second connecting portion.

25. A developing device according to claim 24, wherein said unsealing member is sags more at its central portion than at its end portion.

26. A developing device according to claim 24, wherein said unsealing member includes an engaging surface for engaging with said sealing member and an opposing surface opposing said engaging surface, and wherein said unsealing member includes a reinforcing portion for reinforcing said engaging surface and said opposing surface.

27. A developing device according to claim 26, wherein said reinforcing portion is provided at a plurality of positions with intervals.

28. A developing device according to claim 27, wherein an interval at a central portion is wider than an interval at an end portion.

29. A developing device according to claim 24, wherein said unsealing member has a cross section in one of a U shape, a rectangular shape, and an H shape.

30. A developing device according to claim 24, wherein said first connecting portion is positioned at an end portion and said second connecting portion is positioned at a central portion.

31. A developing device according to claim 24, wherein said first connecting portion is positioned at each of end portions.

32. A developing device according to claim 24, wherein said connecting portion includes a portion linearly bonded to said developer accommodating member.

33. A developing device according to claim 32, wherein said portion linearly bonded to said developer accommodating member linearly extends in the longitudinal direction of said connecting portion.

34. A developing device according to claim 24, wherein said sealing member is peeled by rotation of said unsealing member.

35. A developing device according to claim 24, wherein said unsealing member is supported by a supporting portion at end portions thereof.

36. A developing device according to claim 24, wherein the direction crossing the longitudinal direction is perpendicular to the longitudinal direction of said connecting portion.

37. A developing device according to claim 24, wherein the opening is provided at a plurality of positions.

38. A developing device according to claim 24, wherein said unsealing member has a hollow portion therein.

39. A process cartridge comprising:

a developing device according to claim 24; and an image bearing member for bearing a developer image formed with the developer discharged from said developing device.

40. An image forming apparatus comprising:

a developing device according to claim 36 detachably mounted to a main assembly of said image forming apparatus, wherein an image is formed on a sheet with the developer discharged from said developing device.

* * * * *